US006568946B1

(12) United States Patent
Chou

(10) Patent No.: US 6,568,946 B1
(45) Date of Patent: May 27, 2003

(54) RECEPTACLE ASSEMBLY WITH A MOBILE RECEPTACLE

(76) Inventor: Jonie Chou, 9F-4, No. 232, Chung Ho Road, Chung Ho City, Taipei Hsien (TW)

( * ) Notice: Subject to any disclaimer, the term of this patent is extended or adjusted under 35 U.S.C. 154(b) by 0 days.

(21) Appl. No.: 10/020,901

(22) Filed: Dec. 19, 2001

(30) Foreign Application Priority Data

Nov. 13, 2001 (TW) ..... 90219521 U

(51) Int. Cl.[7] ..... H01R 13/44
(52) U.S. Cl. ..... 439/131; 439/639; 439/650
(58) Field of Search ..... 439/131, 650, 439/651, 652, 654, 639

(56) References Cited

U.S. PATENT DOCUMENTS 5,211,584 A * 5/1993 Lee ..... 439/652
5,231,562 A * 7/1993 Pierce et al. ..... 361/832
5,383,799 A * 1/1995 Fladung ..... 439/652
5,899,761 A * 5/1999 Crane et al. ..... 439/142
6,135,820 A * 10/2000 Chiang ..... 439/654
6,179,665 B1 * 1/2001 Rossman et al. ..... 439/654
6,443,746 B1 * 9/2002 Yu ..... 439/107
6,443,772 B1 * 9/2002 Chen ..... 439/652

* cited by examiner

*Primary Examiner*—Lynn D. Feild
*Assistant Examiner*—Thanh-Tam Le
(74) *Attorney, Agent, or Firm*—Troxell Law Office PLLC

(57) ABSTRACT

A receptacle assembly with a mobile receptacle comprises a receptacle assembly and a mobile receptacle. The receptacle assembly provides an electricity input end and upper outlet units at the upper face thereof with each upper outlet unit being composed of two contact poles and/or a ground line so as to constitute a close circuit for outputting the electricity during the outlet units being plugged in. A receiving device is a locating device with catch parts therein form an outer opening part. The mobile receptacle is received in the receiving device and provides lower outlet units at the upper face thereof with each lower outlet unit being composed of two contact poles so as to form a close circuit with the electricity input end via a lead wire and has at least an engaging part. When the mobile receptacle is taken out from or inserted into the opening part, at least one of the catch parts in the locating device selectively catches the engaging part so that the mobile receptacle may reach out from or enter the receptacle assembly.

13 Claims, 5 Drawing Sheets

RECEPTACLE ASSEMBLY WITH A MOBILE RECEPTACLE

BACKGROUND OF THE INVENTION

1. Field of the Invention

The present invention relates to a receptacle assembly, and particularly to a receptacle assembly with a mobile receptacle, which provides the mobile receptacle received therein and allows the mobile receptacle being pulled out based on the actual need, so as to reduce gross size of the receptacle assembly greatly in practice.

2. Description of Related Art

Generally, stationary receptacles provided indoors/outdoors or extensive receptacles (abbreviated as receptacle assemblies hereinafter) are utilized for being inserted with plugs of electric products for taking electricity. Each outlet unit in a receptacle provides preset contact poles therein in conjunction with the electric power and the electric products provide a plug with insert poles to contact with the is contact poles in the outlet units to constitute power on.

However, the ordinary stationary receptacles are insufficient in practical use due to the electric products are developed incessantly. For instance, a personal computer and the periphery such as a printer, a modem, a sound effect loudspeaker, and a digital camera being used at the same time make the user perplexed in solving a problem of electricity taking. A conventional way to solve the problem is to use a receptacle assembly with multiple outlet units to satisfy the need of electricity taking for multiple electric products.

The preceding receptacle assembly usually provides fixed amount of outlet units but the deficiency of the type receptacle assembly resides in that the gross size of the receptacle assembly becomes huge if too many outlet units such as ten outlet units are set up in the receptacle assembly so that it is not only very hard to arrange the huge size receptacle but also unfavorable for pleasing to the eye. Furthermore, too much less outlet units provided may result in insufficiency in case of increasing electric products so that the only way has to be done is replacing a receptacle assembly with more outlet units.

SUMMARY OF THE INVENTION

A receptacle assembly with a mobile receptacle according to the present invention comprises a receptacle assembly and a mobile receptacle. The receptacle assembly provides an electricity input end and upper outlet units at the upper face thereof with each upper outlet unit being composed of two contact poles and/or a ground line so as to constitute a close circuit for outputting the electricity during the outlet units being plugged in. A receiving device is a locating device with catch parts therein form an outer opening part. The mobile receptacle is received in the receiving device and provides lower outlet units at the upper face thereof with each lower a receptacle assembly and a mobile receptacle. The receptacle assembly provides an electricity input end and upper outlet units at the upper face thereof with each upper outlet unit being composed of two contact poles and/or a ground line so as to constitute a close circuit for outputting the electricity during the outlet units being plugged in. A receiving device is a locating device with catch parts therein form an outer opening part. The mobile receptacle is received in the receiving device and provides lower outlet units at the upper face thereof with each lower outlet unit being composed of two contact poles so as to form a close circuit with the electricity input end via a lead wire and has at least an engaging part. When the mobile receptacle is taken out from or inserted into the opening part, at least one of the catch parts in the locating device selectively catches the engaging part so that the mobile receptacle may reach out from or enter the receptacle assembly.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
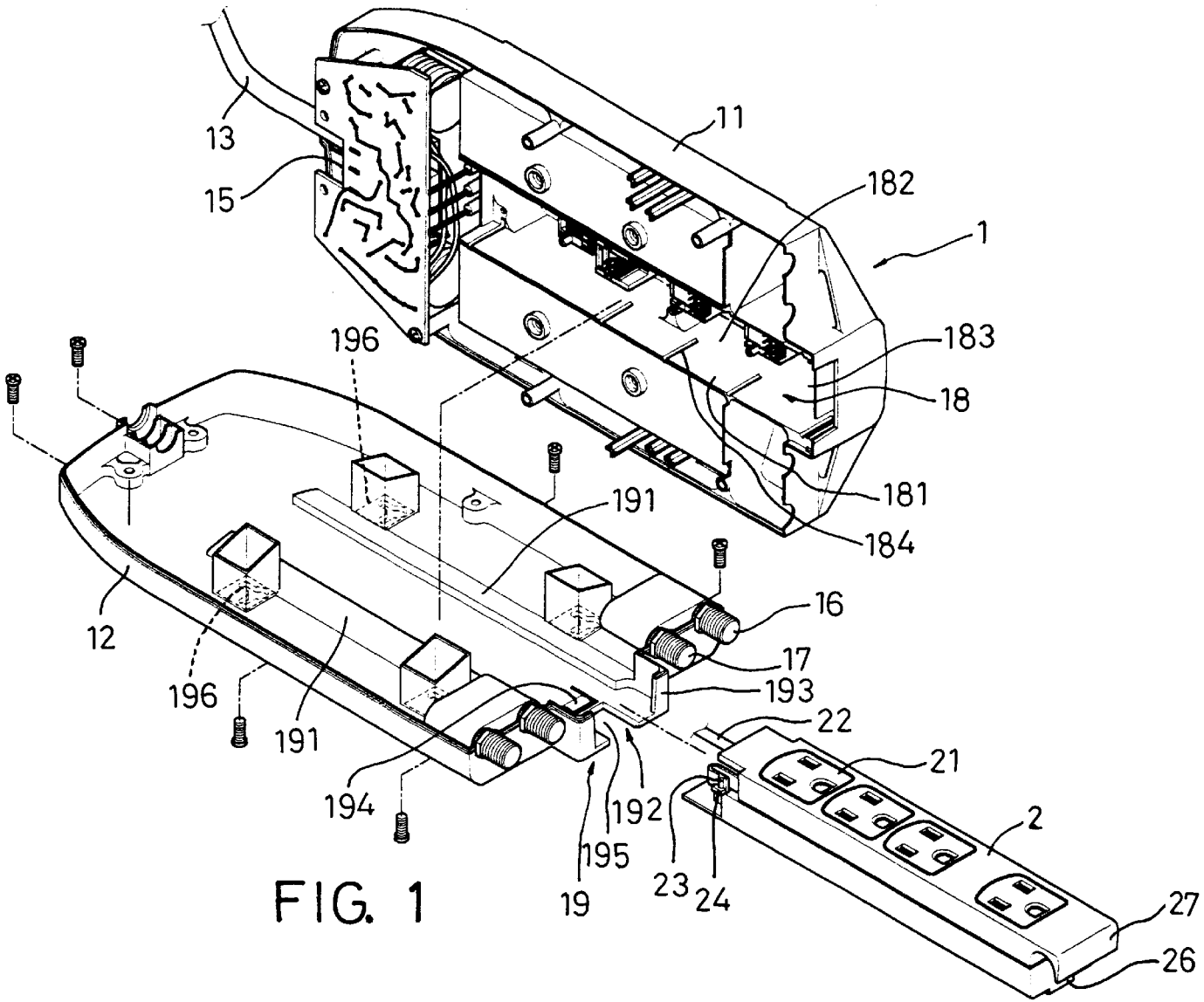
FIG. 1 is an exploded perspective view of a receptacle assembly with a mobile receptacle according to the present invention.
Figure 2:
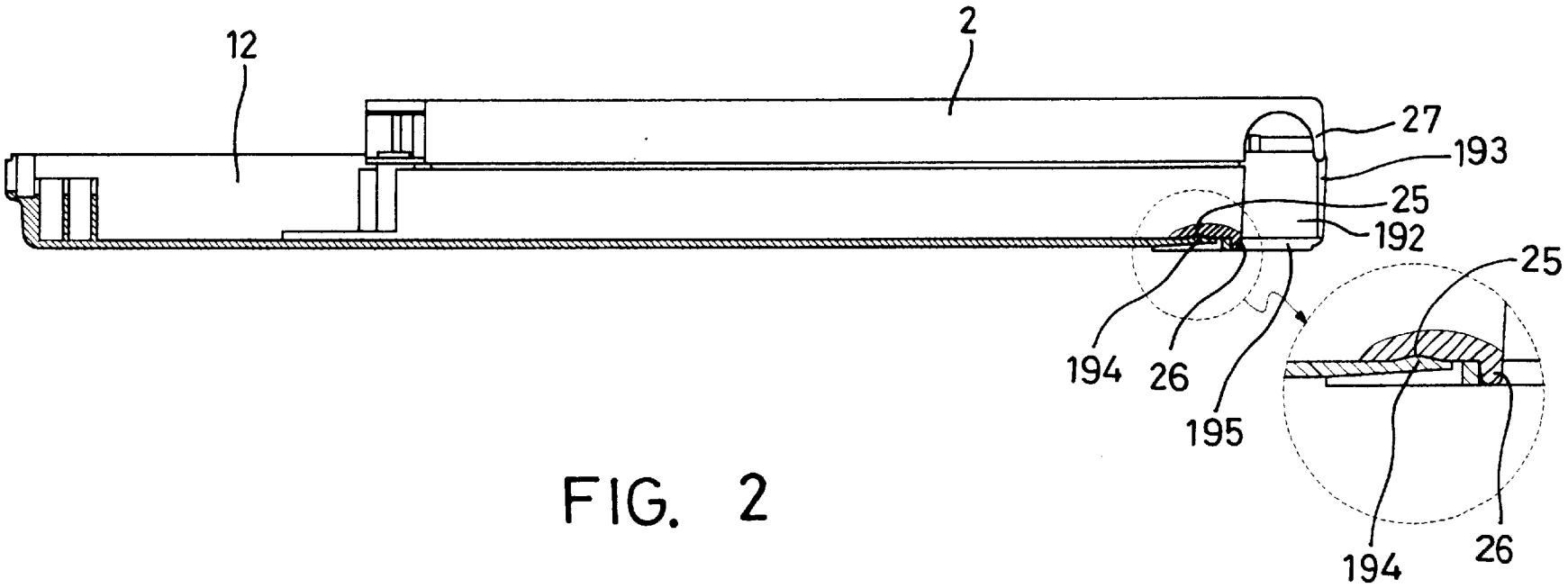
FIG. 2 is a sectional view of the receptacle assembly shown in FIG. 1 attached with a lower cover.
Figure 3:
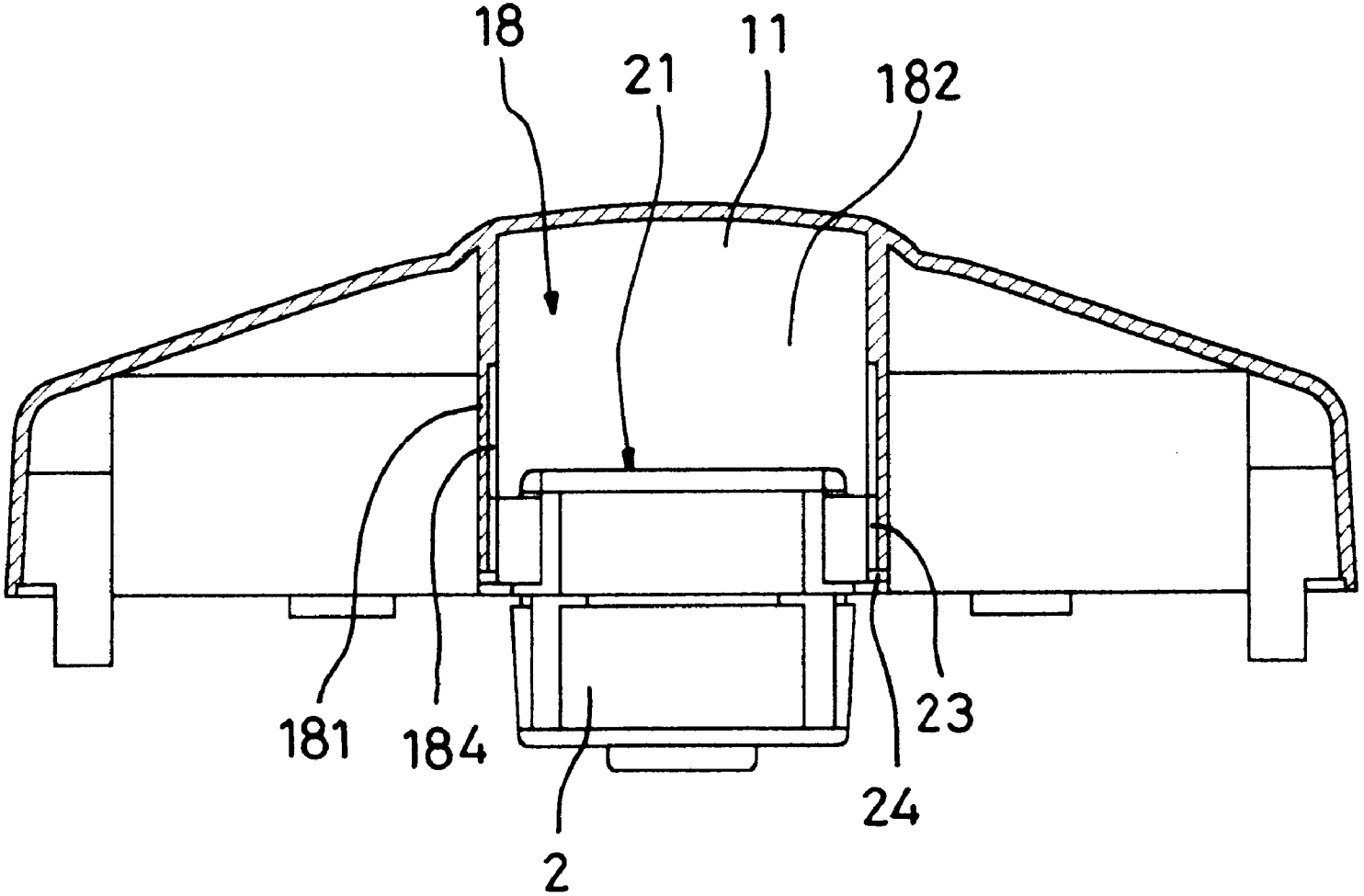
FIG. 3 is a sectional view of the receptacle assembly attached with an upper cover.

Referring to FIGS. 1 to 3, a receptacle assembly with a mobile receptacle according to the present invention comprises a receptacle assembly 1 and a mobile receptacle part 2.

Wherein, the receptacle assembly 1 is composed of an upper cover 11 and a lower cover 12 and the upper cover 11 and the lower cover 12 join with each other oppositely as the conventional receptacle does. The receptacle assembly 1 at an end thereof extends an electricity input end 13 for the external power connecting with a plurality of outlet units 14 attached to the upper cover 11. Each of the outlet units 14 is composed of two preset contact poles and/or a ground line as shown in the figures. The outlet units 14 are oppositely arranged at both lateral sides of the upper cover 11 to reduce the gross length of the receptacle assembly 1. It is noted that above arrangement for the outlet units 14 is one of examples and not the only way can be done. Besides, a three-mode surge absorber 15 can be provided between the electricity input end 13 and the outlet units 14 to enhance the function of protection and the three-mode surge absorber disclosed in the U.S. patent application Ser. No. 09/717,344 or the U.S. patent application Ser. No. 09/717,345 can be adopted in the present invention. The cited references with regard to the surge absorber mentioned here possible to perform a protection for the L-N mode, the L-G mode and the N-G mode respectively. Thus, damage resulting from the leakage or the excessive current can be avoided so as to assure the safety of electric products. The three-mode surge absorber 15 provides three indicating lights 151 to determine if any two of the three modes (L-N mode, L-G mode or N-C mode) are in a status of being under protection. Further, a control of power on/off and an overload reset can be performed via a control switch 152.

Besides, at least a signal input end 16 and at least an output end 17 may be provided to furnish a function of communication such that the telephone signal, the network signal or the cable signal can be input and output via the present invention. Further, Each signal end 16 connects with another surge absorber (it is conventional and not shown in the figures) to assure the stability of output signal from the signal output end 17 and the safety of the electric product.

The characteristic of the receptacle assembly of the present invention is in that a receiving device 18 and a locating device 19 are provided at the inner side of the upper cover 11 and inner side of the lower cover 12 respectively and oppositely. The receiving device 18 has a receiving room composed of two opposite vertical wing plates 181 and has an opening part 183 at the outer side thereof for the mobile receptacle 2 being inserted into the receiving room or pulled out from the receiving room. Further, the two wing plates 181 at the inner surfaces thereof have engaging flutes 184 corresponding to outlet units 21 of the receptacle 2 so that the mobile receptacle 2 can be pulled out stage by stage with being located steadily.

The locating device 19 is disposed in the lower cover 12 and is opposite to the receiving device 18. The locating device 19 provides two opposite guide rails 191 and the guide rails 191 are disposed to space apart each other with a distance same as the width of the mobile receptacle 2. An outer opening part 192 of the locating device 19 provides a respective stopper 193 at both lateral sides thereof for the mobile receptacle 2 being pulled outward limitedly. Further, A room between the slide rails 191 at least an end thereof has an elastic arched projection 194 for engaging with the mobile receptacle 2. The opening part 192 at the bottom of the lower cover has an edge recess 195 to limit the mobile receptacle while the mobile receptacle 2 is inserted inward along the room between the slide rails 191. Furthermore, the lower cover 12 of the receptacle assembly 1 may be provided with a plurality of fixing holes 196 for the receptacle assembly 1 being hung up or fastened up.

The mobile receptacle 2 is elongated and provides a at least an outlet unit 21 composed of two contact poles and/or a ground line with an end thereof having a long lead wire 22 connecting with the electricity input end 13 or a three-mode surge absorber 15 to complete a close circuit. Besides, in order to perform a desirable selected function during taking out the mobile receptacle 2, the mobile receptacle 2 at the rear end thereof has an elastic retaining strip 23 such as a U-shaped engaging retainer to provide an function of catching the engaging flutes 184. The mobile receptacle 2 at the lower side thereof has a lower edge 24 to move along the lower part of the wing plates 181. The mobile receptacle 2 at the bottom thereof provides an arched recess 25 at both ends thereof and at spots opposite to the upper outlet units 14 to engage with engaging projections 194. Furthermore, the mobile receptacle 2 has a guard edge 26 extending downward to press against the edge recess 195. The engaging projections 194 and the retaining strip 23 engage with the outermost recesses 25 and the innermost engaging flutes 184 respectively such that the mobile receptacle 2 can be received in the receptacle assembly 1.

While the mobile receptacle 2 is pushed back to the receiving room, a handle part 27 extends outward for the receptacle 2 being taken out with facility till the two retaining strips 23 catching the two stoppers 193 to reach the outermost limit position of the receptacle.

Figure 4:
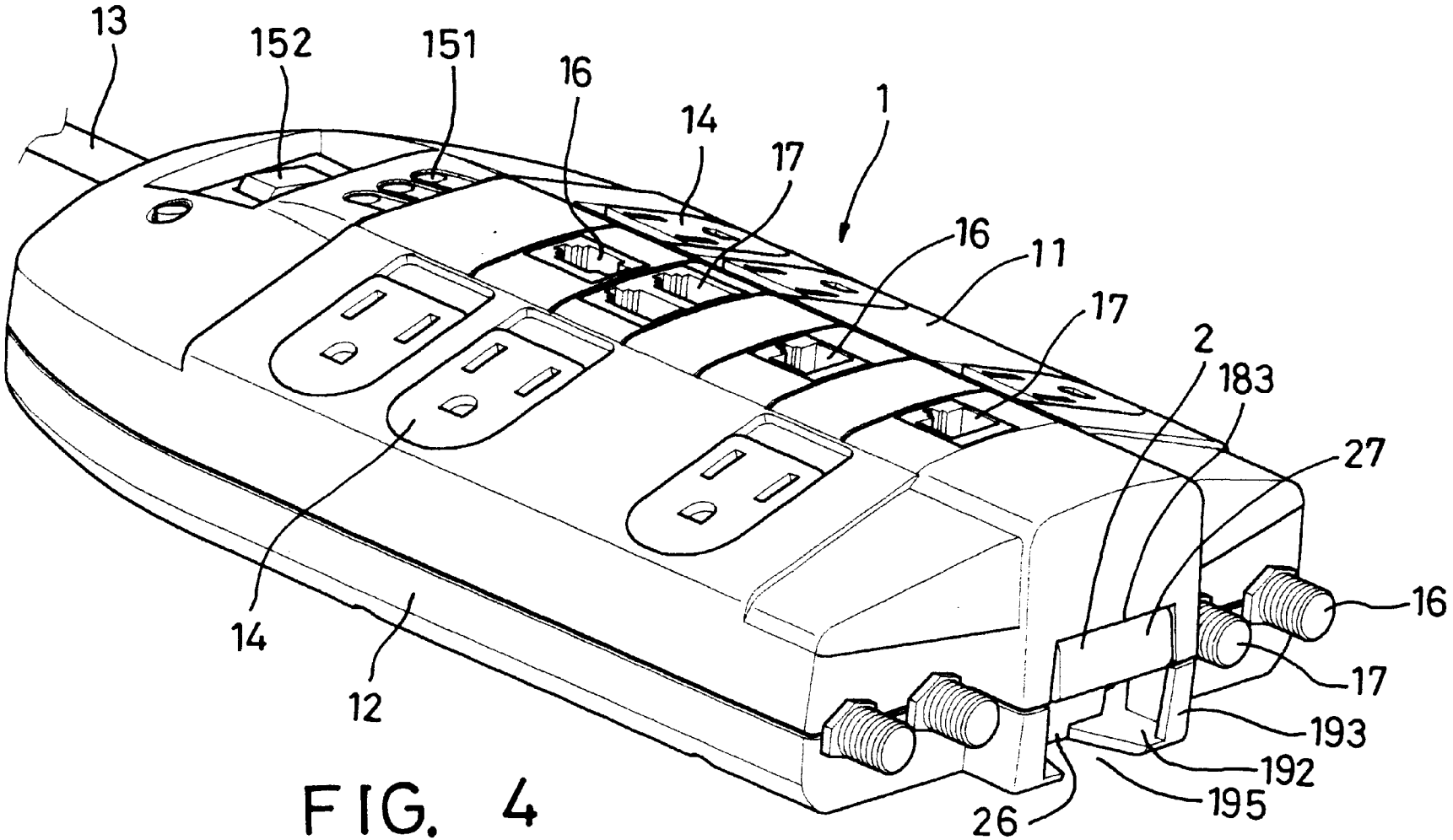
FIG. 4 is an assembled perspective view of the receptacle assembly shown in FIG. 1.
Figure 5:
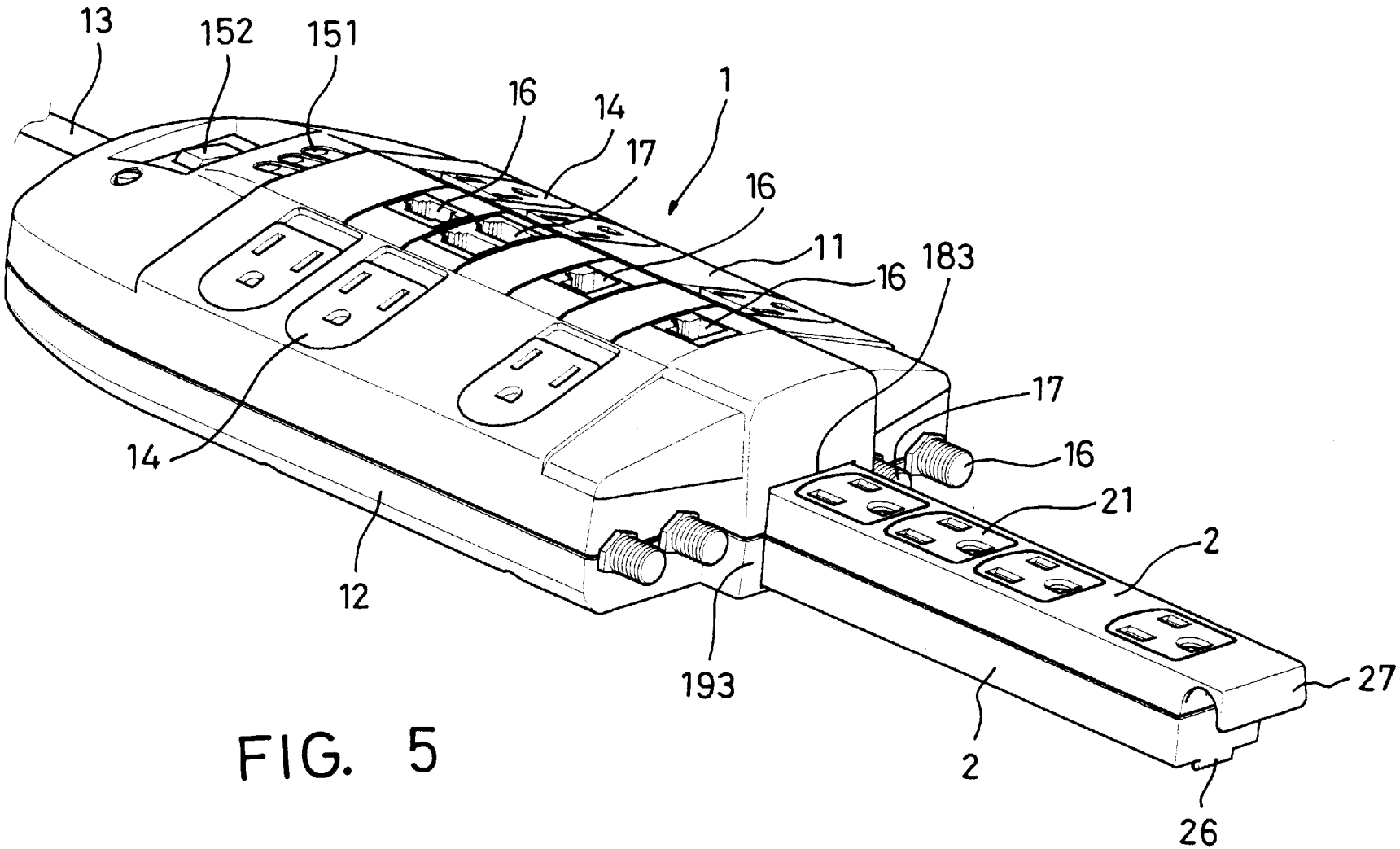
FIG. 5 is a perspective view illustrating the receptacle assembly of the present invention being in state of using.

Referring to FIG. 4, an assembled perspective view of the receptacle assembly with a mobile receptacle according to the present invention is illustrated. Two columns of upper outlet units 14 on the receptacle assembly 1 can be selectively inserted with plugs of electrical products or transformers for offering electricity needed by the electrical products or transformers. In case of the upper outlet units 14 of the receptacle assembly 1 being unable to afford the demand of extra outlets, the handle 27 of the mobile receptacle 2 can be pulled out from the receptacle assembly 1. While the mobile receptacle 2 is taken out, the two retaining strips 23 can engage with the engaging flutes 184 sequentially and the arched recesses 25 can engage with the engaging projections 194 sequentially such that the lower outlet units 21 can be taken out one by one as shown in FIG. 5 for being inserted in case of extra electricity being needed. Inversely, when the insert type receptacle is not in use, it can be pushed back into the receptacle assembly till the stop edge 26 contacting with the edge recess 195. The engaging projections and the retaining strips 23 engage with the outmost arched recesses 25 and the innermost engaging flutes 184 respectively.

It is appreciated from the foregoing that the present invention offers the following advantages: the entire size of the receptacle assembly can be reduced substantially and the mobile receptacle can be taken out one by one based on the actual need till all the middle outlet units exposing outside the receptacle assembly with a maximum available amount of outlets. In addition, all the outlet units may connect with a three-mode surge absorber for the safety of electrical products. Moreover, the present invention can provides signal input/output end to connect with various signals by way of being plugging in for offering stable signal quality. Therefore, the receptacle assembly of the present invention is omni-bearing and the advantages thereof are not possible for the conventional product available in the market to reach effectively.

While the invention has been described with reference to a preferred embodiment thereof, it is to be understood that modifications or variations may be easily made without departing from the spirit of this invention, which is defined in the appended claims.

What is claimed is:

1. A receptacle assembly with a mobile receptacle, comprising:

a receptacle assembly, providing an electricity input end at an longitudinal end thereof and a plurality of upper outlet units at an upper face thereof with each of the upper outlet units composed of two contact poles and/or a ground line so as to constitute a close circuit for being taken the electricity, and providing a receiving device and a locating device with a plurality of catch parts therein so as to form an outer opening part;

an elongated mobile receptacle, being received in the receiving device, providing a plurality of lower outlet units at an outer face thereof with each of the lower outlet units being composed of two contact poles so as to form a close circuit with the electricity input end via a lead wire, and providing at least an engaging part;

whereby, when the mobile receptacle is taken out from or inserted into the opening part, at least one of the catch parts in the locating device selectively catches the engaging part so that the mobile receptacle may reach out from and enter the receptacle assembly.

2. The receptacle assembly with a mobile receptacle according to claim 1, wherein the receiving device has a containing space enclosed with two upright elongated wing plates in the receptacle assembly with a plurality of opposite vertical engaging flutes thereon corresponding to the lower outlet units respectively; and the mobile receptacle at both lateral sides thereof provides an elastic retaining strip respectively on an rear end thereof to selectively engaging two opposite ones of the engaging flutes during moving.

3. The receptacle assembly with a mobile receptacle according to claim 2, wherein each of the retaining strip at a lower edge thereof provides a contact edge area for keeping contact with an edge part of the wing plates while the mobile receptacle is in motion.

4. The receptacle assembly with a mobile receptacle according to claim 1, wherein the locating device provides two opposite guide rails with the engaging part at the outer side thereof being an engaging projection; and the at least engaging part of the mobile receptacle is disposed at both ends thereof and on a bottom thereof and/or corresponding to the lower outlet units respectively and the engaging part is a recess for facilitating the engaging part engaging with the recess.

5. The receptacle assembly with a mobile receptacle according to claim 1, wherein the opening part at both lateral sides provides a stopper respectively to limit the mobile receptacle during moving out while the two retaining strips at the rear end of the mobile receptacle contact with the two stopper.

6. The receptacle assembly with a mobile receptacle according to claim 1, wherein the opening part at a bottom thereof has an edge recess and a front end of the mobile receptacle at a lower edge thereof has a vertical stop edge on the edge power so that a receiving limit of the mobile receptacle occurs at the time of the edge recess contacting with vertical stop edge during moving in.

7. The receptacle assembly with a mobile receptacle according to claim 1, wherein a front end of the mobile receptacle provides a handle.

8. The receptacle assembly with a mobile receptacle according to claim 1, wherein a surge absorber is disposed between the electricity input end and the upper outlet units and the power on/off and reset for the absorber are controlled by a control switch.

9. The receptacle assembly with a mobile receptacle according to claim 8, wherein the surge absorber is a three-mode surge absorber with three indicating lights to indicate three different status of L-N, L-G and N-G respectively.

10. The receptacle assembly with a mobile receptacle according to claim 1, wherein the receptacle assembly provides at least a signal input end and a signal output end.

11. The receptacle assembly with a mobile receptacle according to claim 10, wherein the signal input end is a jack for a telephone line, a network and/or a coaxial cable.

12. The receptacle assembly with a mobile receptacle according to claim 11, wherein the signal input end connects with another surge absorber.

13. The receptacle assembly with a mobile receptacle according to claim 1, wherein the receptacle assembly at a bottom thereof provides a plurality of fixing holes for the receptacle assembly being hung up or locked up.

* * * * *